United States Patent [19]

Martin

[11] Patent Number: 5,042,104

[45] Date of Patent: Aug. 27, 1991

[54] WIPING TOOL FOR CLEANING CEILING TILE GRID STRUCTURES

[76] Inventor: Rodger L. Martin, 13654 E. National Rd., South Vienna, Ohio 45369

[21] Appl. No.: 545,598

[22] Filed: Jun. 29, 1990

[51] Int. Cl.[5] ..... B05C 1/06

[52] U.S. Cl. ..... 15/210 R; 15/228; 15/231

[58] Field of Search ..... 15/210 R, 209 R, 219, 15/220 R, 231, 232, 233, 51, 228

[56] References Cited

U.S. PATENT DOCUMENTS

| | | | |
|---|---|---|---|
| 899,726 | 9/1908 | Goodier | 15/231 |
| 1,130,064 | 3/1915 | Buchanan | 15/231 |
| 1,146,668 | 7/1915 | Tanaka | 15/231 |
| 1,847,046 | 2/1932 | Guerra | 15/231 |
| 4,242,843 | 1/1981 | Phillips | 15/233 |
| 4,688,356 | 8/1987 | Madzgalla | 15/233 |

FOREIGN PATENT DOCUMENTS

| | | | |
|---|---|---|---|
| 1215855 | 11/1959 | France | 15/232 |

*Primary Examiner*—Harvey C. Hornsby
*Assistant Examiner*—Gary K. Graham
*Attorney, Agent, or Firm*—Francis T. Kremblas, Jr.

[57] ABSTRACT

A cleaning accessory tool for wiping ceiling or wall tile support grids which includes a elongate, flexible wiping element movably mounted between releasably fixed positions over a wiping element support surface carried by an elongate handle. In a preferred embodiment, the wiping element is in the form of a relatively long endless belt of a flexible, absorbent material which is selectively advanced over the support surface after a given wiping stroke to expose a clean, unused portion of the wiping element for the next wiping and cleaning stroke. Also disclosed are modified configurations which increase the effective length and usable surface area of the wiping element to effectively clean the grid structure.

6 Claims, 2 Drawing Sheets

WIPING TOOL FOR CLEANING CEILING TILE GRID STRUCTURES

FIELD OF INVENTION

The present invention relates generally to cleaning equipment and particularly to an accessory tool for cleaning the grid system employed in ceiling tile arrangements.

BACKGROUND ART

Ceiling tile, such as most often found in commercial establishments, is supported by a grid system formed typically of metal strips extending lengthwise and laterally across the ceiling at right angles to one another to form a plurality of square or rectangular areas.

In addition to cleaning the ceiling tiles, the metal grids require cleaning from time to time to remove accumulated grease and smoke or dirt deposits. In a conventional fashion, cleaning chemicals are sprayed onto the tiles and grid to loosen or dissolve the dirty deposits. These chemicals and the loosen deposits must be removed from the grid. Conventionally a tool provided with a wiping element in the form of a wet sponge is drawn over only the grid to remove the loosened deposits. Typically, the sponge is cut to a shape conforming closely to the width of the grid strips so as not to contact the ceiling tile which can result in smearing the dirty deposits onto the tile. However, after wiping a relatively short length of the grid strips, typically a few linear feet, the sponge must be rinsed in clean water prior to continuing to wipe off a new section of the grid.

Irrespective of the particular shape of the sponge, these prior wiping tools are limited to wiping off a relatively short length of the grid and then the user must stop to rinse the sponge clean before resuming the wiping operation.

In commercial establishments where large ceiling areas are involved and labor costs represent a majority of the costs, these prior wiping tools are generally less satisfactory than desired as the constant rinsing step is time-consuming and laborious.

A further complication arises when cleaning the last strip of grid which is adjacent to the wall surface. Additional care must be taken to avoid smearing the dirt removed from the grid strip onto the wall. Using prior methods and means it is relatively impossible to avoid such smearing and additional time and labor expense is required to clean any dirt smears from the adjacent wall or ceiling tile surface before the particular job is properly complete.

Smearing the surface of the ceiling tile adjacent to the grid strips also frequently occurs using conventional wiping tools and is particularly a problem when recessed grid systems are encountered.

In some instances, only the grid supports are required to be cleaned. In such cases, the sponge wiper element is dipped into a container of the liquid cleaning chemical, the excess liquid is squeeze out, and the user wipes the grid clean in a similar manner as described above. After each few feet, the sponge wiping element must be rinsed to remove the accumulated dirt and grease and the process is repeated.

Prior to the present invention, those skilled in the art have failed to develop an improved wiping tool for cleaning such ceiling tile grid systems which reduces labor costs and tends to substantially reduce inadvertent smearing of adjacent ceiling tile or wall surfaces.

BRIEF DISCLOSURE OF INVENTION

The present invention relates generally to cleaning tools and particularly to a novel and improved wiping tool particularly well adapted for cleaning grid systems for ceiling tile and the like.

The wiping tool of the present invention includes an elongate handle provided with a wiping element mounting means at one end adapted to receive an elongate wiping element in the form of an absorbent cloth or the like. The wiping element may be releasably fixed in position over the upper surface of the mounting means for wiping a given length of a grid strip by the user simply holding onto the lower portions of the wiping element while gripping the handle in a normal fashion. Then the user may simply and easily advance the wiping element over the mounting means support surface to expose the next adjacent unused, clean area of the wiping element, thereby quickly resume wiping the next length of the grid. This procedure is repeated for substantially the full length of the wiping element until substantially the whole of one side of the wiping element has been used.

In a preferred embodiment of the present invention, the wiping element is joined at its ends in the form of a continuous belt. One end thereof is draped over the mounting surface and the opposing end is releasably mounted over a laterally extending bar or rail longitudinally spaced from the first mentioned mounting means to permit the wiping element to be more conveniently and selectively moved along its length as a user progressively uses a clean portion to wipe the grid strips.

In another preferred embodiment the first mentioned mounting element is provided with a plurality of flat or planar surfaces, preferably provided with a high friction covering to reduce unwanted slippage or movement of the wiping element when it is stabilized for actual use to wipe the grid strips. In a particularly preferred embodiment, the mounting means is rotatably mounted to more conveniently expose the next adjacent unused, clean area of the wiping element in an efficient and easily measured manner.

In a further preferred embodiment, the mounting means and the planar support surfaces are provided with different configurations adapted to conform closely with a recessed grid structure or for the perimeter grid strips disposed adjacent to adjoining side wall surfaces to more efficiently clean the grid strips and reduce the occurrence of smearing the removed dirt and grease deposits onto adjoining ceiling or wall surfaces.

In a particularly preferred embodiment, the planar surfaces are at least twice as wide as the width of the grid being cleaned with one portion of each of the planar surfaces being inclined relative to the remaining portion of the same planar surface. This feature permits multiple use of the wiping element without longitudinal movement thereof while providing clearance between the ceiling tile and a laterally spaced, used portion of the wiping element to avoid soiling the adjacent ceiling tile.

In those instances where only the grid or some other surface is to be cleaned without first spraying the surface with cleaning chemicals, the wiping element of the present invention may be thoroughly wet with the cleaning solution prior to mounting it on the handle. After any excess liquid cleaning solution is removed, the wet cleaning element is mounted on the handle over the support surface in the same previously described manner. The user merely wipes an appropriate length of surface being cleaned and then exposes a fresh, unused portion of the wiping element by advancing it over the support surface as described above herein.

OBJECTS

It is therefore an object of the present invention to provide a novel and improving wiping tool to aid in cleaning the grid structure supporting ceiling wall tile through more efficient use of a wiping element and assuring a clean used portion of the wiping element is conveniently available for use.

It is another object to provide an apparatus of the type described which eliminates the necessity of frequently rinsing of the wiping element during the cleaning of ceiling or wall tile grid structure or other hard, non-porous surfaces to reduce the manual labor and cost as compared to conventional methods and means.

Figure 1:
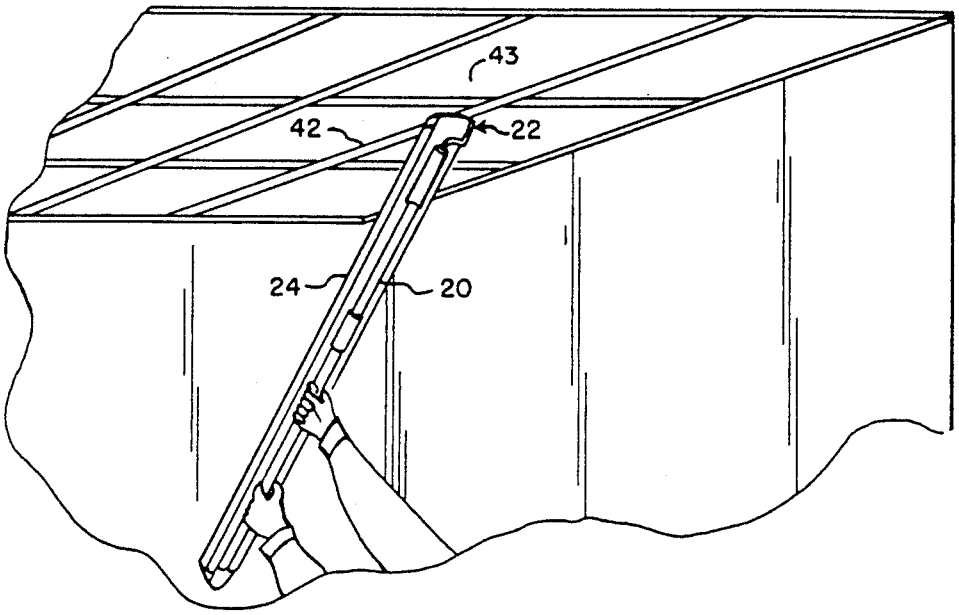
FIG. 1 is a perspective view of a cleaning tool for ceiling tile grid structure constructed in accordance with the present invention illustrated during use.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

Figure 2:
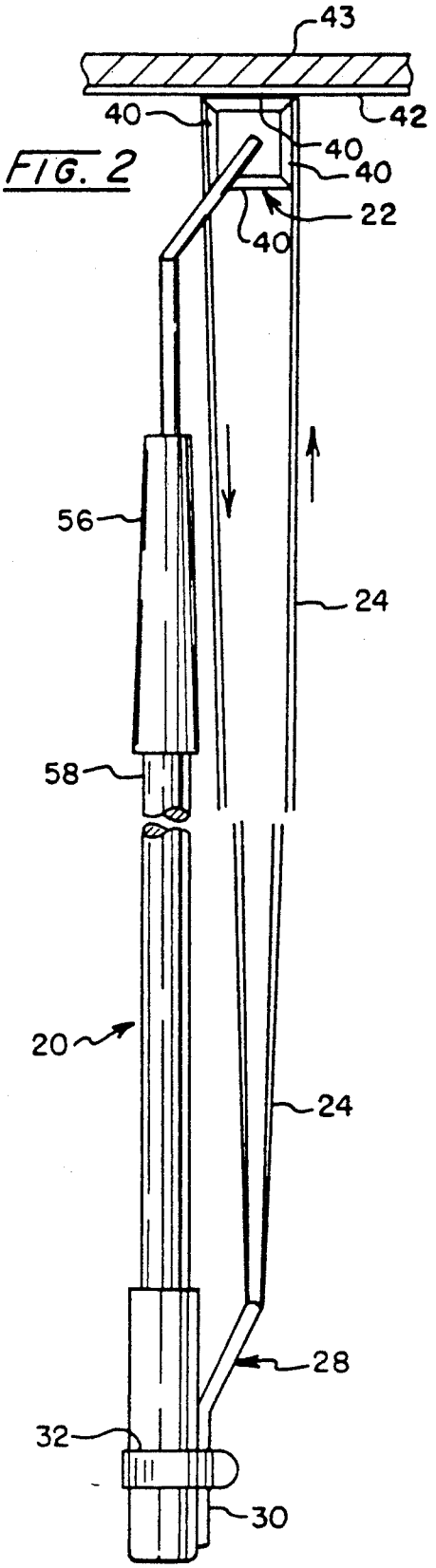
FIG. 2 is a side elevational view of the apparatus shown in FIG. 1.
Figure 3:
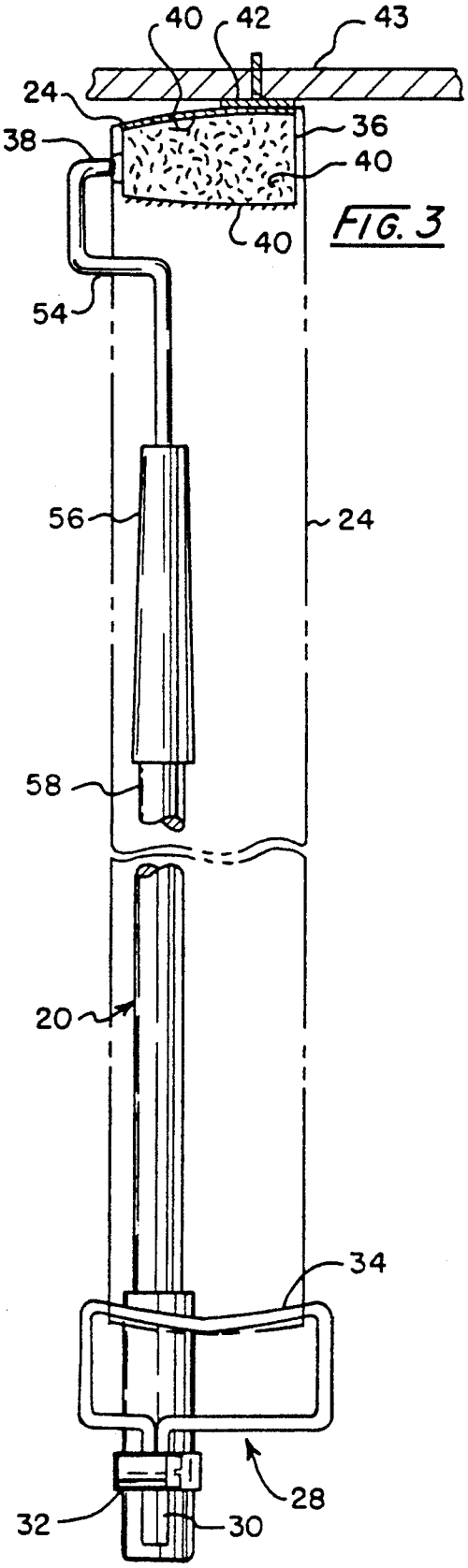
FIG. 3 is a front elevational view of the apparatus shown in FIG. 2 with the outline of the wiping element shown by ghost lines.

A tool for cleaning ceiling or wall tile support grid structure constructed in accordance with the present invention is shown in FIGS. 1–3 and includes an elongate handle portion, indicated generally at 20, a wiping element mounting and support means, indicated generally at 22, and a elongate wiping element in the form of a flexible absorbent cloth 24.

In the preferred embodiment shown in FIGS. 1–3, a second wiping element mounting means 28 in the form of a generally rod-like metal support. Mounting means 28 comprises a metal rod bent in a generally rectangular configuration with its ends forming a pair of downwardly extending leg portions 30. Leg portions 30 may be fixed to handle 20 in any conventional manner such as by metal collar 32.

Wiping element or cloth strip 24 preferably is provided with means to detachably connect its opposing end portions to one another, such as by snaps or the well-known Velcro fastener means, so as to form an endless or continuous belt. Once mounted over the upper surface of mounting and support means 22, a free end of wiping element 24 is extended under an upper, laterally extending side of the rectangular shaped mounting means 28, such as seen in FIGS. 2 and 3, and connected to the opposing end to form the endless belt configuration to mount wiping element over mounting means 22 in a freely movable manner for longitudinal advancement.

Wiping element 24 must be movable along its length to selectively expose an unused portion over the uppermost surface of mounting means 22 to obtain the advantages of the present invention. Such movement may be accomplished in a slidable manner if mounting means 22 and 28 are fixed, such as the slideably engagement with the upper side 34 of lower mounting means 28. Alternatively, as seen in the preferred embodiment shown, relative to mounting means 22 either or both mounting means may be rotatably mounted so that wiping element may be advanced in a pulley-like manner by pulling on one side of the wiping element extending over mounting means 22.

As seen in FIGS. 2 and 3, mounting means 22 comprises a mounting block 36 pivotally mounted in any conventional manner on a horizontally extending rod-like portion 38 of the upper portion of handle 20. Rod-like portion 38 extends into a bore, not shown, provided in block 36. Block 36 preferably is provided with a plurality of planar faces, four such faces are shown in FIGS. 2 and 3. Each face forms a planar support surface for wiping element 24 when the face is rotated and disposed in a generally horizontal uppermost position, such as face 40 shown in FIG. 3, engagement with and presenting a portion of wiping element 24 in a parallel relationship to a grid strip.

The wiping element may be stabilized in this operative position, by the user simply grasping an area of both sides of wiping element 24 extending downwardly parallel to handle 20 between his fingers and handle 20. The tool is then ready to use to wipe a portion of a grid strip, such as 42, as illustrated in FIGS. 1–3.

In the preferred embodiment, each face, such as 40, is provided with a roughened or other friction gripping surface to reduce slippage of wiping element 24 upon force-transmitting engagement with the grids strip during the wiping process in which the cleaning chemicals and the loosen dirt and grease are removed from the strip.

The length of the planar support surface 40 in a longitudinal direction relative to the length of grid strip 42 is preferably at least between one to three inches to provide a sufficient surface area of the wiping element to contact and absorb the cleaning chemicals and remove the loosen dirt and grease. This allows a reasonably practical stroke length of at least about two feet and preferably up to about three or four linear feet for each wiping stroke prior to advancing the wiping element. After each wiping stroke is completed, wiping element 24, is merely advanced as described above herein, to expose a fresh, unused portion in the operable position.

An advantage of providing rotatable planar support faces on mounting block 36 is that the user has a visual indication of how far to advance the wiping element 24 to be assured a clean area is in position by observing when the next face 40 is rotated to the top position shown in FIGS. 2 and 3. This also makes more efficient use of the total length of wiping element 24 to reduce any tendency to advance wiping element farther than necessary to expose a clean, unused portion for the next wiping step. The disclosed procedure is repeated until substantially the total length of wiping element 24 has been used. To replace wiping element 24, the ends of the used wiping element 24 are detached and a new wiping element is positioned between mounting means 22 and 28 as described above.

If the wiping element comprises a relatively thick and absorbent cloth material, one may also use its unused, clean opposite side by turning it over and treating the opposing side in the same replacement manner as described above for mounting a new wiping element.

To obtain even more efficient use of the wiping element and also save additional labor time in the cleaning operation, the faces 40 of the mounting block are configured at least slightly greater than twice as long as the width of the grid strip 42 supporting the ceiling tile 43. Further, the planar surface 40 is divided into two essentially flat surfaces, one being slightly inclined relative to the other which gives the tapered configuration seen in FIG. 3. The wiping element is sufficiently wide to cover the whole length of face 40. After a first wiping stroke is made, as seen in FIG. 3, a second wiping stroke can be made with the unused, clean portion of the wiping element 24 covering the inclined surface of face 40 prior to longitudinally advancing the wiping element.

The few degrees of inclination of a portion of face 40 provides a clearance between the extra width of the wiping element 24 when using the laterally spaced portion to wipe the grid strip 42. After the first wiping stroke, the user must tilt handle and mounting block 36 to fully engage the inclined portion of mounting block 36 in a parallel manner to the grid strip 42. During this second wiping stroke the used portion of wiping element 24 over the lateral spaced portion of block 36 is disposed in an incline manner away from the ceiling tile so as not to smear the cleaning chemicals or dirt carried by the used portion of the wiping element 24 onto the adjacent ceiling tile surfaces.

Using this configuration of block 36, provides for significantly more efficient use of a single wider wiping element 24 since, in effect, two wiping strokes can be made before the length of the wiping element must be advanced to position a fresh, unused surface area in the operative position.

Figure 5:
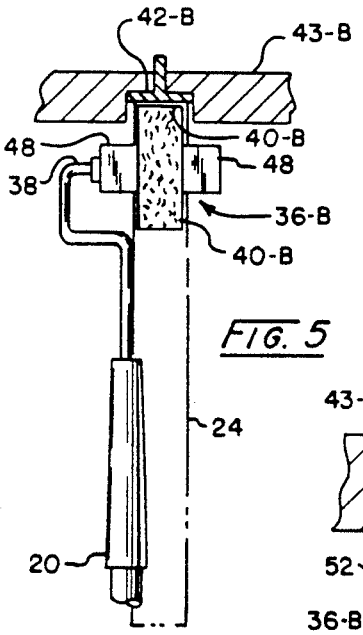
FIG. 5 is a front elevational view similar to the view shown in FIG. 3 illustrating another embodiment of the present invention provided with a modified wiping element mounting means adapted for cleaning a recessed ceiling tile grid structure.
Figure 4:
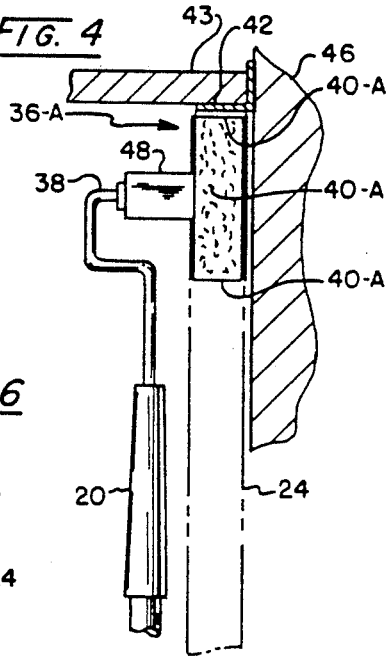
FIG. 4 is a front elevational view of another embodiment of the present invention illustrating a wiping element mounting means having a modified configuration adapted to clean a ceiling tile grid strip disposed adjacent to a side wall.

Now referring to FIGS. 4 and 5, modified embodiments of the present invention are shown. The reference numbers used to describe components identical to those described with reference to the embodiment shown in FIGS. 1–3 are used to refer to identical components in the embodiments of FIGS. 4 and 5. Modified portions of the embodiments shown in FIGS. 4 and 5 which are analogous to portions of the embodiment of FIGS. 1–3 will be referenced by the same reference numerals followed by the letter A or B.

With specific reference to FIG. 4, the upper portion of handle 20 is rotatably mounted to a modified mounting block 36-A which is generally constructed the same manner as block 36 shown in FIGS. 1–3 except for its specific configuration. The configuration of block 36-A includes an upstanding position having a smaller dimension of the operative portion of planar face 40-A parallel to the axis of rotation. This dimension is closely approximates the width of the grid strip 42 to be cleaned.

If desired, the modified block 36-A is most useful to wipe the grid strips 42 located adjacent to perimeter of the ceiling which meets the side wall 46 of the room being cleaned. However, it should be noted that the embodiment of FIGS. 1–3 also can be advantageously used to do the same perimeter grid strips, however, the inclined surface portion of face 40 cannot be used as described above for strips disposed adjacent to an adjoining side wall surface.

Figure 6:
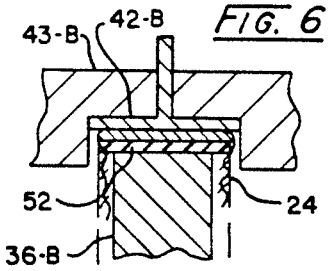
FIG. 6 is a partial front elevational sectional view of the apparatus shown in FIG. 5 showing the upper portion of the wiping element mounting means in enlarged detail, the section being taken along the centerline of the mounting means.

With specific reference to FIGS. 5 and 6, another modification of the proceeding embodiments is shown. This embodiment differs from the embodiment of FIG. 4 in that the effective contacting surfaces of mounting block 36-B are centrally located on the narrower non-contacting portions 48 which are rotatably mounted on the rod 38 of handle 20. This construction provides somewhat greater stability to the operative supporting surfaces 40-B which is designed primarily for wiping grid structures 42-B recessed within the ceiling tile 43-B. Such stability is useful to make it easier for the user to avoid contacting the side walls of the recess during a wiping stroke. The width of the upstanding operative portion of block 36-B is slightly less than the width of grid strip 42-B to allow for the bulk of the wiping element 24 extending downwardly along each side of block 36-B to fit within the recess provided in ceiling tile 43-B.

It has been found advantageous to provide a relatively thin strip of flexible material 52, such as a synthetic rubber, fixed to each wiping element planar support surface 40-B which slightly overhangs the outer edges of support surface 40-B, a distance less than the width of the recess in the ceiling tile 43-B and the grid strip 42 disposed therein.

It has been found that this arrangement provides very satisfactory contact and cleaning of grid strip 42 while providing a small clearance between the edge of strip 52 to reduce the tendency to damage the inner walls forming the recess in ceiling tile 43-B.

The flexible nature of strip 5 also provides adequate width in combination with the bulk of wiping element 24 overhanging its outer edges to contact substantially the whole surface area of grid strip 42 yet be relatively soft and flexible enough to reduce or eliminate inadvertent chipping or flaking away of the inner walls of the recessed tile upon engagement with the recess in the ceiling tile 43-B during a wiping stroke.

Of course, as an alternative, the whole of mounting block 36 could be made of a relatively soft or flexible material, however, it appears that the construction described in FIGS. 5 and 6 is relatively easy to manufacture and works quite well.

In operation, the embodiments shown in FIGS. 1–6 are used and operated in essentially the same manner, the different configurations are mainly directed to special circumstances related to the location of the grid strips being cleaned.

Using either embodiment, the wiping element is draped over the top surface of mounting blocks 36, 36-A or 36-B such that the free ends of the wiping element extend downwardly toward mounting means 28. One free end is inserted under upper rod 34 and detachably fastened to he other end in any conventional manner. Preferably the length of wiper element 24 is dimensioned to approximate twice the distance between mounting support means 22 and 28 to provide a very light tension fit sufficient to allow the user to easily grasp both downwardly extending sides of wiping element 24 while maintaining a grip on handle 20 when the user wishes to stabilize wiping element 24 for use. Also, the degree of tension allows relatively easy advance of the wiping elements as needed.

After wiping an appropriate lineal length of a grid strip, the user pulls on one side of wiping element 24 while the other side is free, thereby causing mounting block 36, 36-B or 36-C to rotate and advance a clean, unused portion of wiping element 24 into an operative position. This procedure is repeated until the length of the wiping element 24 has been used.

It should be noted that other configurations of a suitable handle 20 may be used conveniently within the context of the present invention. However, the common goose-neck or offset type handle portion 54 which is removably mounted via a threaded or tapered mating end such as 56, to an elongate extension 58 such as commonly used in paint rollers, works very well with the present invention. The offset is preferably sufficient to allow wiping element 24 to extend downwardly on one side of handle 20.

It should be pointed out that an enlarged, non-tapered mounting means support surface can be substituted for those described herein for applications in which a larger, planar surface of any non-porous material is to be cleaned. In either the dry state for wiping a previously applied cleaning solution off a surface or in a pre-wetted state for applying and wiping a cleaning solution over a surface, the ease of advancing the wiping element to a clean, unused portion remains the same. The frequent rinsing after each cleaning stroke or, at best, cleaning a relatively small area is eliminated. After the whole length of the cleaning element has been used, it can be easily replaced. In such uses, the cleaning tool of the present invention has a broad application for cleaning a variety of surfaces in either a commercial or residential household setting in a much easier fashion than conventional mops, sponges and the like.

In view of the foregoing description, it should be readily understood that the present invention represents a substantial improvement over the prior art means used to conventionally wipe and/or clean ceiling tile grid structures or other non-porous surfaces. Compared to the rinsing step necessary after each wiping strokes using the prior art tools, the tool of the present invention permits a user to more quickly and more conveniently accomplish the cleaning task using considerably less labor and eliminates a time-consuming and wasteful motion involved in the rinsing of the cleaning element. The ease involved in advancing a clean, unused portion of the wiping element tends to eliminate the tendency of the user to continue to use a soiled portion of the wiping element over too long a wiping stroke as often happens when a rinsing step is required.

While certain preferred embodiments of the present invention have been disclosed in detail, it is to be understood that various modifications may be adopted without departing from the spirit of the invention or scope of the following claims.

I claim:

1. An improved apparatus for manual cleaning or wiping a generally planar surface comprising, in combination:

a) an elongate handle portion having a first end and a second oppositely disposed end spaced from one another to define a selected length and conformed to permit manual gripping and manipulation by a human user to make cleaning and wiping strokes;

b) a first wiping element mounting means connected to and extending beyond said first end of said handle portion and including a wiping element support surface extending laterally relative to the length dimension of said handle portion and conformed to engage said planar surface to be cleaned in a generally parallel extending relationship;

c) a second wiping element mounting means connected to said handle portion and disposed laterally and in longitudinally spaced relationship from said first end of said handle means toward said second end of said handle means; and d) an elongate strip forming an endless belt wiping element movably mounted for longitudinal movement on said first and second mounting means in laterally spaced and longitudinally extending relationship to said handle means, said spaced relationship being selected to allow a user to simultaneously grip said handle portion and a portion of said wiping element to releasably fix said wiping element against longitudinal movement relative to said wiping element support surface while making said cleaning and wiping strokes.

2. The apparatus defined in claim 1 wherein said wiping element is slideably mounted over said support surface.

3. The apparatus defined in claim 1 wherein said support surface of said first wiping element mounting means is mounted for rotation about an axis generally perpendicular to the length of said handle and includes a plurality of planar surfaces conformed to engage said planar surface being cleaned in a substantially parallel relationship.

4. The apparatus defined in claim 1 wherein said support surface is covered with means to increase frictional engagement with said wiping element.

5. The apparatus defined in claim 3 wherein said planar support surfaces are covered with means to increase frictional engagement with said wiping element.

6. The apparatus defined in claim 1 wherein said support surface includes a first laterally extending planar portion joining a second laterally extending planar portion inclined downwardly at an acute angle relative to a plane formed by said first planar portion.

* * * * *